United States Patent [19]

Taylor

[11] 4,426,633

[45] Jan. 17, 1984

[54] DEVICES CONTAINING PTC CONDUCTIVE POLYMER COMPOSITIONS

[75] Inventor: James M. Taylor, Mountain View, Calif.

[73] Assignee: Raychem Corporation, Menlo Park, Calif.

[21] Appl. No.: 254,352

[22] Filed: Apr. 15, 1981

[51] Int. Cl.[3] ..... H01C 3/04

[52] U.S. Cl. ..... 338/25; 338/22 R; 29/612

[58] Field of Search ..... 338/25, 22 R; 29/610, 29/611, 612; 219/505

[56] References Cited

U.S. PATENT DOCUMENTS

| | | | |
|---|---|---|---|
| 2,952,761 | 9/1960 | Smith-Johannsen | 29/611 |
| 3,351,882 | 11/1967 | Kohler et al. | 338/322 |
| 3,535,494 | 10/1970 | Armbruster | 219/528 |
| 3,632,971 | 1/1972 | Flanagan | 219/505 X |
| 4,314,230 | 2/1982 | Cardinal | 338/25 |

FOREIGN PATENT DOCUMENTS

| | | |
|---|---|---|
| 8235 | 2/1980 | European Pat. Off. . |
| 2321751 | 3/1977 | France . |
| 2368127 | 5/1978 | France . |
| 2423037 | 11/1979 | France . |
| 1595198 | 8/1981 | United Kingdom . |
| 1604735 | 12/1981 | United Kingdom . |

*Primary Examiner*—C. L. Albritton

*Attorney, Agent, or Firm*—Timothy H. P. Richardson

[57] ABSTRACT

Electrical devices comprising a conductive polymer element, preferably a PTC element, and at least one metal foil electrode. Preferred devices are circuit protection devices. The devices can be made by laminating the foil to the conductive polymer element under controlled conditions of time, temperature and pressure.

13 Claims, 4 Drawing Figures

DEVICES CONTAINING PTC CONDUCTIVE POLYMER COMPOSITIONS

BACKGROUND OF THE INVENTION

1. Field of the Invention

This invention relates to devices containing conductive polymer compositions.

2. Summary of the Prior Art

Conductive polymer compositions, and devices comprising them, are known. Reference may be made for example to U.S. Pat. Nos. 2,978,665 (Vernet et al.), 3,221,145 (Hager), 3,243,753 (Kohler), 3,311,852 (Rees), 3,351,882 (Kohler et al), 3,448,246 (Armbruster), 3,535,494 (Armbruster) 3,571,777 (Tully), 3,691,349 (MacColl et al), 3,793,716 (Smith-Johannsen), 3,823,217 (Kampe), 3,861,029 (Smith-Johannsen), 4,017,715 (Whitney et al), 4,085,286 (Horsma et al), 4,135,587 (Diaz), 4,177,376 (Horsma et al), 4,177,446 (Diaz), 4,188,276 (Lyons et al) 4,237,441 (Van Konynenburg et al) and 4,246,468 (Horsma); U.K. Pat. No. 1,534,715; the article entitled "Investigations of Current Interruption by Metal-filled Epoxy Resin" by Littlewood and Briggs in J. Phys D: Appl. Phys, Vol. II, pages 1457–1462; the article entitled "The PTC Resistor" by R.F. Blaha in Proceedings of the Electronic Components Conference, 1971; the report entitled "Solid State Bistable Power Switch Study" by H. Shulman and John Bartho (August 1968) under Contract NAS-12-647, published by the National Aeronautics and Space Adminstration; J. Applied Polymer Science 19, 813–815 (1975), Klason and Kubat; Polymer Engineering and Science 18, 649–653 (1978) Narkis et al; and U.S, Ser. Nos. 750,149 (Kamath et al), now abandoned, published as German OLS No. 2,755,077; 732,792 (Van Konynenburg et al), now abandoned, published as German OLS No. 2,746,602; 751,095 (Toy et al), now abandoned, published as German OLS No. 2,755,076; 798,154 (Horsma et al), now abandoned, published as German OLS No. 2,821,799; 965,344 (Middleman et al), now U.S. Pat. No. 4,238,812; 965,345 (Middleman et al), now U.S. Pat. No. 4,315,237; and 6,773 (Simon), now U.S. Pat. No. 4,255,698. For details of more recent developments in this field, reference may be made to U.S. Ser. Nos. 41,071, (Walker), now U.S. Pat. No. 4,272,471 67,207 (Doljack et al) now abandoned, 88,304 (Lutz) now U.S. Pat. No. 4,361,799, 97,711 (Middleman et al), 141,984 (Gotcher et al), 141,987 (Middleman et al) now U.S. Pat. No. 4,315,237 141,988 (Fouts et al), 141,989 (Evans), 141,990 (Walty), now U.S. Pat. No. 4,314,231 141,991 (Fouts et al), 142,053 (Middleman et al), now U.S. Pat. No. 4,352,083, 142,054 (Middleman et al), now U.S. Pat. No. 4,317,027, 150,909 (Sopory), 150,910 (Sopory), now U.S. Pat. No. 4,334,351 and 150,911 (Sopory), now U.S. Pat. No. 4,318,881 and the application Ser. No. 364,179 filed on Apr. 2, 1981, by Jacobs et al (MP0762). The disclosure of each of the patents, publications and applications referred to above is incorporated herein by reference.

Many of the electrical devices comprising conductive polymers make use of generally planar electrodes, and for each electrodes the use of foraminous electrodes, especially metal mesh electrodes, has been most generally recommended and found to be of practical value in order to achieve adequate physical adhesion between the conductive polymer and electrode, coupled with low contact resistance. However, the use of foraminous electrodes inevitably leads to some degree of electrical non-uniformity; furthermore if the surface of the electrode closest to the other electrode has any imperfections, this can lead to electrical stress concentration which will cause poor performance. This problem is particularly serious when the conductive polymer exhibits PTC behavior, since it can cause creation of a hot zone adjacent the electrode; it also becomes increasingly serious as the distance between the electrodes gets smaller. Ser. No. 141,990 (Walty) describes planar electrodes which are layers of flame-sprayed metal; such layers can be produced either by flame-spraying the metal directly onto the conductive polymer or by laminating the conductive polymer with a layer of metal previously sprayed onto a carrier, e.g. a film. The possibility of using metal foil electrodes in heating devices comprising conductive polymers is also disclosed in the prior art. For example U.S. Pat. Nos. 3,448,246 (Armbruster) and 3,535,494 (Armbruster) discloses planar heaters which comprises a planar conductive polymer element, e.g. a PTC element, which is sandwiched between two metal foils, each preferably 10 to 25 microns thick. Such foils, according to U.S. Pat. No. 3,535,494 can be applied to the element in any convenient manner. However, there is no description in either patent of any specific procedure in which the foils were united to the element, or indeed of any specific conductive polymer element. U.S. Pat. No. 3,221,145 (Hager) discloses large area (generally at least $1\times4$ feet) electric heaters which comprise a planar conductive polymer element which is sandwiched between two metal foils, each of thickness 0.0001 to 0.01 inch. The conductive polymer has a resistivity of $4\times10^3$ to $4\times10^7$ ohm.cm and the element is 0.2 to 0.001 inch thick. The method of making such heaters which is disclosed in the patent comprises coating each of the foils with a liquid conductive polymer mix, e.g. a polymeric latex which is then dried, followed by lamination of the two coated foils under heat and pressure. U.S. Pat. No. 3,691,349 (Mac Coll) describes a heating element which comprises a polysiloxane-based conductive polymer element to which metal foil electrodes are secured by eyelets. U.S. Pat. No. 3,311,862 (Rees) discloses heating elements which comprise a planar conductive polymer element which is sandwiched between two metal foils. Rees refers to the difficulty of bonding conductive resinous films to metallic foils, and in order to overcome this difficulty he makes use of a conductive polymer which comprises carbon black dispersed in plasticised polyvinyl chloride and bonds the conductive polymer element to the metallic foils by means of a key coat comprising carbon black dispersed in a resinous binder containing 25–75% of a vinyl chloride/vinyl acetate copolymer and 75–25% of a vinyl chloride/vinyl alcohol copolymer.

SUMMARY OF THE INVENTION

I have now discovered that metallic foil electrodes can be secured to conductive polymer elements without making use of the inconvenient and/or expensive measures indicated as necessary by the prior art.

In one aspect the invention provides a method of making an electrical device which comprises (a) an element composed of a conductive polymer composition which comprises
  (i) a polymer component and
  (ii) a particulate conductive filler which is dispersed in said polymer component;
(b) a first electrode which is a metal foil; and (c) a second electrode;

said first and second electrodes being connectable to a source of electrical power and, when so connected, causing current to flow through said element; which method comprises (1) forming said conductive polymer composition into a shaped element;

(2) bringing the shaped element from step (1) into direct or indirect face-to-face contact with a metal foil;

(3) subjecting the shaped element and the metal foil to heat and pressure; and (4) cooling the shaped element and the metal foil while exerting sufficient pressure thereon to ensure that they remain in firmly adherent contact after the cooling is complete.

The laminate from step (4) can then be cut into pieces as desired, to provide, for example devices having the preferred characteristics set out below.

In another aspect, the invention provides an electrical device which comprises (a) an element composed of a conductive polymer composition and (b) a laminar, e.g. planar, curved or corrugated, electrode which is in electrical contact with said conductive polymer element and which is a metal foil;

said conductive polymer element and said metal foil being in direct or indirect face-to-face contact with each other and being firmly adherent to each other, the device having at least one of the following features:

(1) The conductive polymer element comprises at least one PTC element which is composed of a conductive polymer which exhibits PTC behavior.

(2) The metal foil electrode is in direct physical and electrical contact with a conductive polymer element, preferably a PTC conductive polymer element.

(3) The device comprises two (or more) electrodes which can be connected to a source of electrical power and which when so connected cause current to flow through the PTC element. Preferably both electrodes are metal foil electrodes as defined; the thickness of the conductive polymer element between two metal foil electrodes can be very small, e.g. less than 0.03 inch, for example 0.01 to 0.02 inch.

(4) The device has a resistance at 23° C. of less than 1000 ohms, preferably less than 100 ohms, more preferably less than 1 ohm. Devices of very low resistance can be made, e.g. less than 0.1 ohm and even lower, e.g. less than 0.01 ohm, and are useful as circuit protection devices in circuits having high normal operating currents.

(5) The device has a maximum dimension less than 12 inches, preferably less than 2 inches.

(6) The metal foil has a thickness less than 0.02 inch, preferably less than 0.1 inch, especially less than 0.005 inch, e.g. 0.0005 to 0.002 inch. The thicker the foil, the more difficult it is to ensure that voids are not created when uniting the foil to the element.

(7) There are substantially no voids between the metal foil electrode and the conductive polymer element.

(8) At 23° C., the measured resistance of the device is at most two times, preferably at most 1.5 times, particularly at least 1.2 times, the calculated resistance of the device based on the resistivity of the conductive polymer composition calculated from the resistance of a plaque of the composition with silver paint electrodes thereon.

(9) The resistance of the device at 23° C. increases by a factor of at most 3, preferably at most 2, when it is subjected to a test routine in which the device, in still air at 23° C., is part of a test circuit which consists essentially of the device, a DC power source of voltage 24 volts and a switch, the test routine consisting of N test cycles, where N is 200, and each test cycle consisting of closing the switch in the test circuit for 30 seconds, whereby the device is converted into a high temperature high resistance state, and then opening the switch and allowing the device to cool to 23° C. before starting the next test cycle.

BRIEF DESCRIPTION OF THE DRAWINGS

The invention is illustrated in the accompanying drawings, in which.

DETAILED DESCRIPTION OF THE INVENTION

The process defined above preferably includes one or more of the following features.

Figure 1:
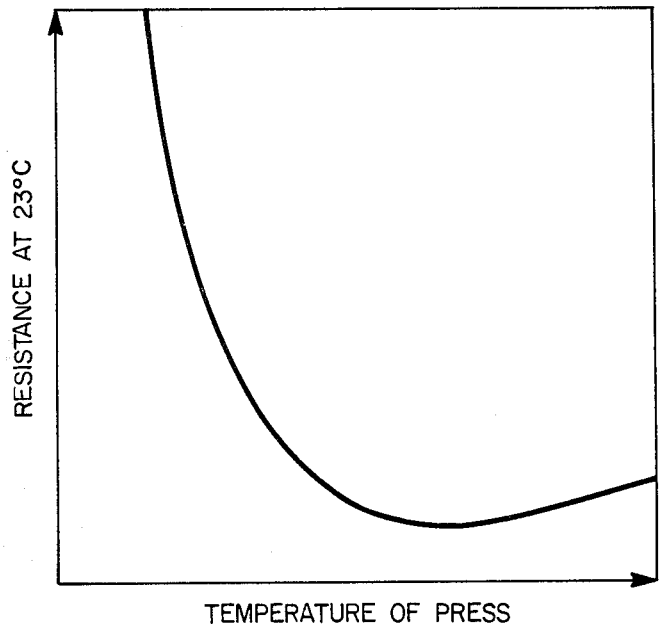
FIG. 1 shows the relationship between the temperature used to laminate metal foil electrodes to a PTC conductive polymer element and the resistance of the resulting product.

(1) In step (c), the temperature of the metal foil and at least the part of the element in contact therewith is selected so that the resistance of the resulting product is minimized. I have found that there is an optimum temperature range for step (c) which results in a product having desired properties. Following identical procedures except that the temperature in step (c) is varied, I have found that as the temperature is increased, the resistance falls sharply, then levels out, and then increases slowly, as illustrated in FIG. 1. When using conductive polymer compositions based on crystalline polymers, the temperature preferably employed instep (c) appears to be related to the crystalline melting point(s) of the polymer or polymers in the conductive polymer composition. Thus the temperature is preferably at least $(T_1+45)$°C., particularly at least $(T_1+50)$°C., especially at least $(T_1+60)$°C., where $T_1$ is the crystalline melting point of the highest melting polymer. On the other hand the temperature should preferably not be too high and therefore preferably should be not more than 140° C. above, particularly not more than 130° C. above, especially not more than 120° C. above, the crystalline melting point of the lowest melting polymer in the conductive polymer composition.

Figure 2:
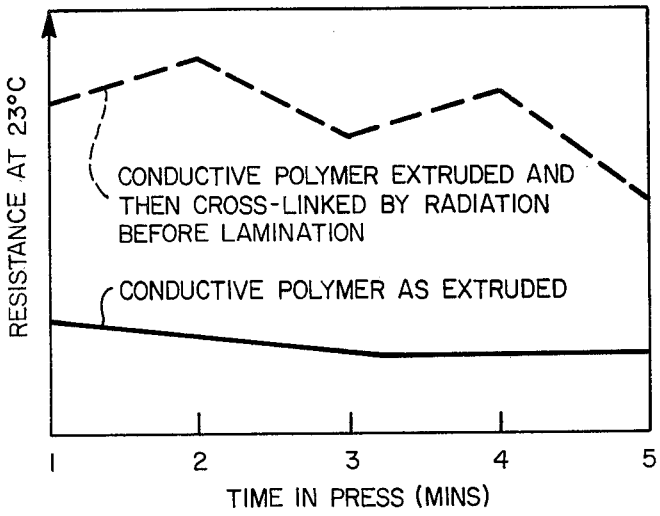
FIG. 2 shows the relationship between the time used to laminate metal foil electrodes to a PTC conductive polymer element (either radiation cross-linked or as extruded) and the resistance of the resulting product.

(2) In steps (c) and (d), the times employed should be adequate to minimize the resistance of the resulting product. I have found that in a process carried out in a static press, the time in step (c) is preferably at least 2 minutes, particularly at least 2.5 minutes, e.g. 3 minutes or more. FIG. 2 shows the effect of pressing time on resistance.

Figure 3:
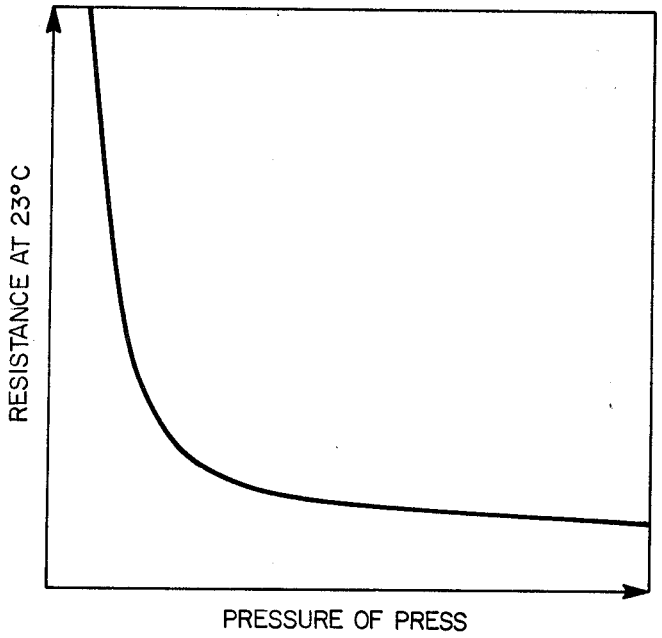
FIG. 3 shows the relationship between the pressure used to laminate metal foil electrodes to a PTC conductive polymer element and the resistance of the resulting product.
Figure 4:
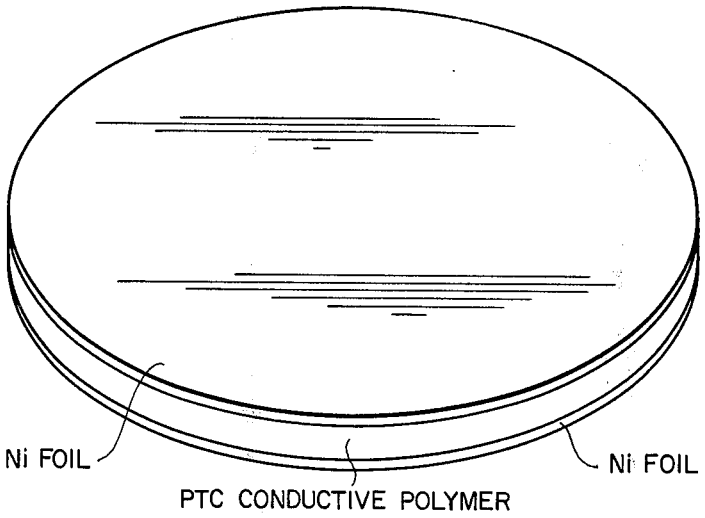
FIG. 4 shows a circuit protection device of the present invention.

(3) In step (c), the pressure employed is sufficient to cause adequate bonding of the metal foil and the conductive polymer, but not so great as to cause distortion of the components. The effect of pressure on resistance is shown in FIG. 3. Pressures of 175 to 275 psi are prefered.

The conductive polymers used in this invention may exhibit PTC, ZTC or NTC behavior, and may be for example as described in the patents and applications incorporated by reference herein. Preferably they are melt-processable. The conductive polymer element may be of uniform composition or can comprise two or more elements of different composition, e.g. a PTC layer having a ZTC layer adjacent one or both faces thereof. Preferably the polymer component comprises at least 80% by weight of one or more crystalline polymers, especially a mixture of at least one polyolefin, e.g. polyethylene or polypropylene, and at least one copolymer of an olefin, e.g. ethylene, and a polar comonomer, e.g. acrylic acid, ethyl acrylate or vinyl acetate.

Preferably the metal foil electrode is in direct physical contact with the conductive polymer element, but the possibility of using an intermediate layer of a conductive adhesive is not excluded. Conductive adhesive generally are applied as liquids, are not melt-processable, and have resistivities lower than the conductive polymers on which they are placed.

The conductive polymer element can be cross-linked, by radiation or chemically, but cross-linking is preferably effected after the metal foil electrode has been secured to the element.

The invention is illustrated by the following Example.

EXAMPLE

A conductive polymer composition was prepared using the ingredients and amounts thereof listed below.

| | Wt (g) | Wt % | Vol % |
|---|---|---|---|
| Ethylene/ethyl acrylate copolymer (EAA 455) | 4687 | 29.7 | 38.3 |
| High density polyethylene (Marlex 6003) | 3756 | 23.8 | 29.7 |
| Carbon Black (Furnex N765) | 7022 | 44.5 | 29.7 |
| Antioxidant | 316 | 2.0 | 2.3 |

Notes
EAA 455 is available from Dow Chemical Co. and is a copolymer of ethylene and acrylic acid containing % by weight of units derived from acrylic acid and having a melting point of about 95° C.
Marlex 6003 is available from Phillips Petroleum and is a high density polyethylene with a melt index of 0.3 and a melting point of about 135° C.
Furnex N765 is available from and is a carbon black having a particle size of 60 millimicrons and a surface area of 30 $m^2/g$.
The antioxidant used was an oligomer of 4,4-thiobis (3-methyl-6-tert.butyl phenol) with an average degree of polymerization of 3-4, as described in U.S. Pat. No. 3,986,981.

These ingredients were introduced into a steam-preheated 25 lb. (11.4 kg) Banbury mixer. When the torque increased considerably, the steam was turned off and water cooling was begun. Mixing was continued for six minutes in third gear. The composition was then dumped, placed on a steam-heated mill, extruded into a water bath through a 3.5 inch (8.9 cm) extruder fitted with a pelletizing die, and chopped into pellets. The pellets were dried under vacuum at 60° C. for 18 hours.

Using a 1.5 inch (3.8 cm) Davis-Standard extruder fitted with a 6 inch (15.2 cm)×0.025 inch (0.064 cm) die, the pellets were extruded into a tape which was drawn to give a 4.5 inch (11.4 cm)×0.015 inch (0.033 cm) product. This sheet was cut into samples 5 inches (12.7 cm) long.

Electrodes were attached to the samples as follows. The laminar members specified below were stacked in the order shown.

(1) 5×5 inch (12.7×12.7 cm) stainless steel platen.
(2) 5×5 inch (12.7×12.7 cm) fluoroglass sheet (a release sheet of glass-fiber reinforced polytetrafluoroethylene).
(3) 5×5×0.0625 inch (12.7×12.7×0.16 cm) polysiloxane sheet.
(4) Same as member (2).
(5) 5×5×0.001 inch (12.7×12.7×0.003 cm) nickel foil (available from Teledyne Rodney as Nickel 200 annealed).
(6) 4.5×5×0.015 inch (11.4×12.7×0.033 cm) conductive polymer sample prepared as described above.
(7) Same as member (5).
(8) Same as member (2).
(9) Same as member (3).
(10) Same as member (2).
(11) Same as member (1).

Using an electric press having a 4 inch (10.2 cm) diameter ram, the stack of laminar members was placed in the press and the temperature of the press was maintained at 200° C. for 2 minutes with the ram exerting a contact pressure of not more than 1000 lb. (454 kg) total, (about 44.5 psi, 3.1 $kg/cm^2$); expansion of the silicone pads on heating made it necessary to adjust the ram pressure during heating to prevent excessive pressure. The ram pressure was then increased to 5000 lb. (2270 kg) total, (about 220 psi, 15.5 $kg/cm^2$) for 3 minutes. The stack was transferred to a cool press and cooled for 2 minutes while maintaining a pressure of 5000 lb. (2270 kg); contraction of the silicone pads on cooling made it necessary to adjust the ram pressure during cooling. The stack was then removed from the press and a laminate of the conductive polymer sheet and the nickel foils, now firmly adherent to each other, was removed.

Using a punch press with a blanking punch, circuit protection devices were then obtained by stamping out discs 0.625 inch (1.59 cm) in diameter from the laminate.

The discs were irradiated to 20 MRAD in a gamma source.

I claim:

1. A method of making an electrical circuit protection device which comprises (a) a laminar PTC element composed of a melt-extruded conductive polymer composition which exhibits PTC behavior, which has a resistivity at 23° C. of less than 100 ohm.cm, and which comprises
  (i) a polymer component which comprises at least one crystalline polymer and
  (ii) a particulate conductive filler which is dispersed in said polymer component;
(b) a first laminar electrode which is adherent to one face of the PTC element and which is a metal foil; and
(c) a second electrode which is adherent to the opposite face of the PTC element and which is a metal foil;

said first and second electrodes being connectable to a source of electrical power and, when so connected, causing current to flow through said element; which method comprises (1) melt-extruding said conductive polymer composition into a continuous, laminar shaped element;

(2) bringing one face of the shaped element from step (1) into face-to-face contact with a first metal foil;

(3) bringing the other face of the shaped element from step (1) into face-to-face contact with a second metal foil;

(4) subjecting the shape element and the metal foils to heat and pressure;

(5) cooling the shaped element and the metal foils while exerting sufficient pressure thereon to ensure that they remain in firmly adherent contact after the cooling is complete; and (6) cutting the laminate from step (5) into a plurality of circuit protection devices each of which has a maximum dimension of less than 2 inches and a resistance at 23° C. of less than 100 ohms.

2. A method according to claim 1 wherein the metal foil is brought into direct contact with the conductive polymer element.

3. A method according to claim 1 wherein the PTC element is less than 0.03 inch thick.

4. A method according to claim 3 wherein the PTC element is 0.01 to 0.02 inch thick.

5. A method according to claim 1 wherein the devices cut from the laminate have a resistance at 23° C. of less than 1 ohm.

6. A method according to claim 5 wherein the devices cut from the laminate have a resistance at 23° C. of less than 0.1 ohm.

7. A method according to claim 1 wherein each of the metal foil electrodes is less than 0.005 inch thick.

8. A method according to claim 7 wherein each of the metal foil electrodes is 0.0005 to 0.002 inch thick.

9. A method according to claim 1 wherein steps (4) and (5) are carried out under conditions such that the device has a resistance at 23° C. which is at most 2 times the calculated resistance of the device based on the resistivity of the conductive polymer composition calculated from the resistance of a plaque of the composition with silver paint electrodes thereon.

10. A method according to claim 1 wherein steps (4) and (5) are carried out under conditions such that the device has a resistance at 23° C. which increases by a factor of at most 3, when the device is subjected to a test routine in which the device, in still air at 23° C., is part of a test circuit which consists essentially of the device, a DC power source of voltage 24 volts and a switch, the test routine consisting of N test cycles, where N is 200, and each test cycle consisting of (a) closing the switch in the test circuit for 30 seconds, whereby the device is converted into a high temperature high resistance state, (b) opening the switch and (c) allowing the device to cool to 23° C., before starting the next test cycle.

11. A method according to claim 1 wherein steps (4) and (5) are carried out under conditions such that in the final laminate there are substantially no voids between the metal foil electrodes and the PTC element.

12. A method according to claim 1 wherein the conductive polymer composition contains a single crystalline polymer having a melting point $T_1$, and the temperature in step (3) is from $(T_1+45)$°C. to $(T_1+140)$°C.

13. A method according to claim 1 wherein the conductive polymer composition contains at least two crystalline polymers and the temperature in step (3) is from $(T_1+45)$°C. to $(T_2+140)$°C., where $T_1$ is the melting point of the lowest-melting crystalline polymer and $T_2$ is the melting point of the highest-melting crystalline polymer.

* * * * *